US009341122B2

(12) United States Patent
Cho

(10) Patent No.: US 9,341,122 B2
(45) Date of Patent: May 17, 2016

(54) EXHAUST BRAKE

(71) Applicants: Hyundai Motor Company, Seoul (KR); Kia Motors Corporation, Seoul (KR)

(72) Inventor: Jae Seoul Cho, Whasung-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 80 days.

(21) Appl. No.: 14/226,574

(22) Filed: Mar. 26, 2014

(65) Prior Publication Data

US 2015/0136075 A1 May 21, 2015

(30) Foreign Application Priority Data

Nov. 20, 2013 (KR) ..... 10-2013-0141621

(51) Int. Cl.

| | |
|---|---|
| ***F02D 9/06*** | (2006.01) |
| ***F02D 9/10*** | (2006.01) |
| *F01L 13/06* | (2006.01) |
| *F02D 9/04* | (2006.01) |
| *F02B 3/06* | (2006.01) |
| *F02B 75/02* | (2006.01) |

(52) U.S. Cl.

CPC ..... *F02D 9/06* (2013.01); *F02D 9/1055* (2013.01); *F01L 13/065* (2013.01); *F02B 3/06* (2013.01); *F02B 2075/025* (2013.01); *F02D 9/04* (2013.01); *F02D 9/106* (2013.01)

(58) Field of Classification Search

CPC ..... F02D 9/06; F02D 9/04; F01L 13/065; F02B 3/06; F02B 2075/025

USPC ..... 123/323

See application file for complete search history.

(56) References Cited

U.S. PATENT DOCUMENTS

| | | | | |
|---|---|---|---|---|
| 6,179,096 | B1 * | 1/2001 | Kinerson et al. | 188/154 |
| 2003/0080610 | A1 | 5/2003 | Jung | |
| 2007/0245561 | A1 | 10/2007 | Miyauchi et al. | |
| 2008/0223450 | A1 | 9/2008 | Kino et al. | |
| 2010/0006053 | A1 | 1/2010 | Kondo | |
| 2010/0319657 | A1 | 12/2010 | Dodi et al. | |

FOREIGN PATENT DOCUMENTS

| | | | |
|---|---|---|---|
| DE | 198 21 130 | A1 | 11/1998 |
| GB | 2 307 718 | A | 6/1997 |
| JP | 10-1998-085344 | A | 12/1998 |

(Continued)

OTHER PUBLICATIONS

Types of Valves, Jun. 6, 2012, Integrated, DOE-HDBK-1018/2-93, 1 and Wayback Dating.*

*Primary Examiner* — Lindsay Low
*Assistant Examiner* — Charles Brauch
(74) *Attorney, Agent, or Firm* — Morgan, Lewis & Bockius LLP

(57) ABSTRACT

An exhaust brake may include an exhaust pipe configured to include an exhaust upstream and an exhaust downstream, a butterfly configured to be mounted between the exhaust upstream and the exhaust downstream in the exhaust pipe, a bypass pipe configured to include a bypass upstream starting between the exhaust upstream and the butterfly and a bypass downstream ending between the butterfly and the exhaust downstream, and a check valve configured to be mounted between the bypass upstream and the bypass downstream. The piston head of a piston of the check valve may be disposed at the bypass downstream and a direction in which the piston head moves to the bypass downstream is a direction in which the check valve is opened.

12 Claims, 6 Drawing Sheets

(56) References Cited

FOREIGN PATENT DOCUMENTS

| | | | | |
|---|---|---|---|---|
| KR | 10-1998-085344 | | | 12/1998 |
| KR | 100204897 | B1 | | 3/1999 |
| KR | 100428159 | B1 | | 4/2004 |
| KR | 20090056607 | A | * | 1/2009 |
| KR | 20120025555 | A | | 3/2012 |
| WO | WO 99/24732 | A1 | | 5/1999 |

* cited by examiner

EXHAUST BRAKE

CROSS-REFERENCE TO RELATED APPLICATION

The present application claims priority of Korean Patent Application Number 10-2013-0141621 filed on Nov. 20, 2013, the entire contents of which application are incorporated herein for all purposes by this reference.

BACKGROUND OF INVENTION

1. Field of Invention

The present invention relates to an exhaust brake, and more particularly, to an exhaust brake capable of maximizing assist brake performance without affecting an engine by keeping a predetermined back pressure even in a high speed section and a middle-low speed section without a loss in the back pressure by applying a check valve to a back pressure forming part so as to satisfy an engine allowable back pressure.

2. Description of Related Art

An exhaust brake is an apparatus which forms a back pressure at an engine exhaust side and applies a load to the engine so that a brake is caught.

FIG. 1 is a perspective view illustrating an exhaust brake according to the related art. As illustrated in FIG. 1, an exhaust pipe 10 is equipped with a butterfly 20, in which the butterfly 20 rotates based on a rotating shaft 22 to stop or open the exhaust pipe. The rotating shaft of the butterfly rotates by a force which allows a cylinder 30 mounted outside the exhaust pipe to push a rod 32. When the butterfly 20 stops the exhaust pipe 10, the back pressure rises. In this case, the back pressure applies a load to the engine so that the brake is caught.

Meanwhile, the butterfly 20 according to the related art is equipped with a hole 24 to satisfy an engine allowable back pressure. However, since the hole 24 permits a flow of air at all times, the back pressure may not formed properly in a middle-low speed section, such that brake performance may be suddenly degraded. Further, when a size of the hole is small to prevent the brake performance from degrading, the large back pressure is generated in a high speed section and thus exceeds the allowable back pressure, such that a cylinder head of an engine may be damaged.

As such, the exhaust brake structure according to the related art which does not properly exert the brake performance in the middle-low speed section is not suited to a current development trend or direction in automobile industry which seeks to downsize the engine.

Meanwhile, the butterfly 20 is opened and closed by the cylinder 30. Due to the structure of the butterfly 20, a gap between the butterfly 20 and an inner diameter portion of the exhaust pipe 10 cannot but be formed at both ends of the rotating shaft 22, such that air tightness may be reduced and the brake performance may be reduced.

Further, when the cylinder is operated to open and close the butterfly, a force which allows the butterfly to be pulled to the cylinder is applied in a shaft direction of the rotating shaft 22 and thus the butterfly is jammed into the exhaust pipe 10, such that an operation defect that the butterfly is not opened and closed properly may occur.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made to solve the above-mentioned problems occurring in the prior art and/or other problems while advantages achieved by the prior art are maintained intact. Various aspects of the present invention provide for an exhaust brake with excellent performance even in a middle-low speed section.

In one aspect of the present invention, there is provided an exhaust brake, including: an exhaust pipe configured to include an exhaust upstream and an exhaust downstream; a butterfly configured to be mounted between the exhaust upstream and the exhaust downstream in the exhaust pipe; a bypass pipe configured to include a bypass upstream starting between the exhaust upstream and the butterfly and a bypass downstream ending between the butterfly and the exhaust downstream; and a check valve configured to be mounted between the bypass upstream and the bypass downstream, wherein a piston head of a piston of the check valve is disposed at the bypass downstream and a direction in which the piston head moves to the bypass downstream is a direction in which the check valve is opened.

The check valve may include: a cover configured to form an appearance of the check valve, a piston configured to allow a piston rod to be slidably inserted into the cover in a longitudinal direction, and a spring configured to elastically support the piston in a direction in which the check valve is closed.

The spring may include a coil spring which is inserted outside the piston and is received in the cover, one side of the spring may be supported by the cover, and the other side of the spring may be supported by the piston.

The piston rod may be movably inserted with a piston guide in a longitudinal direction, an end of the piston rod may be screw-fastened with a nut to prevent the piston guide from separating from the piston rod in the state in which the piston rod is inserted with the piston guide, and a movable range of the piston guide with respect to the piston rod may be controlled by controlling a position of the nut.

The other side of the spring may be supported by the piston guide and thus the other side of the spring may be supported by the piston.

The cover may be divided into a spring receiving part, a gas passage part, and a piston rod support part between the spring receiving part and the gas passage part along the longitudinal direction of the piston which is inserted into the cover, the piston head may be disposed at the gas passage part side, the piston rod support part may have a cross section corresponding to a cross section of the piston rod, and the spring receiving part may have the spring received therein.

Both ends of a rotating shaft of the butterfly may be equipped with bushings. The both ends of the rotating shaft may be provided with reduction parts of a diameter and the bushings may be mounted at the reduction parts.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
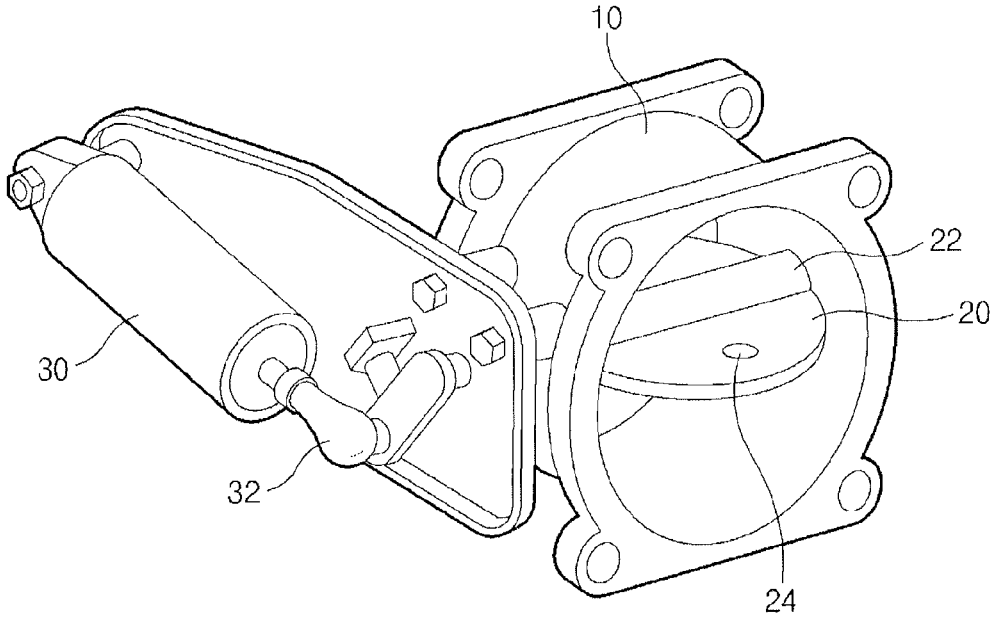
Fig. 1 (Related Art)
FIG. 1 is a perspective view illustrating an exhaust brake according to the related art.
Figure 2:
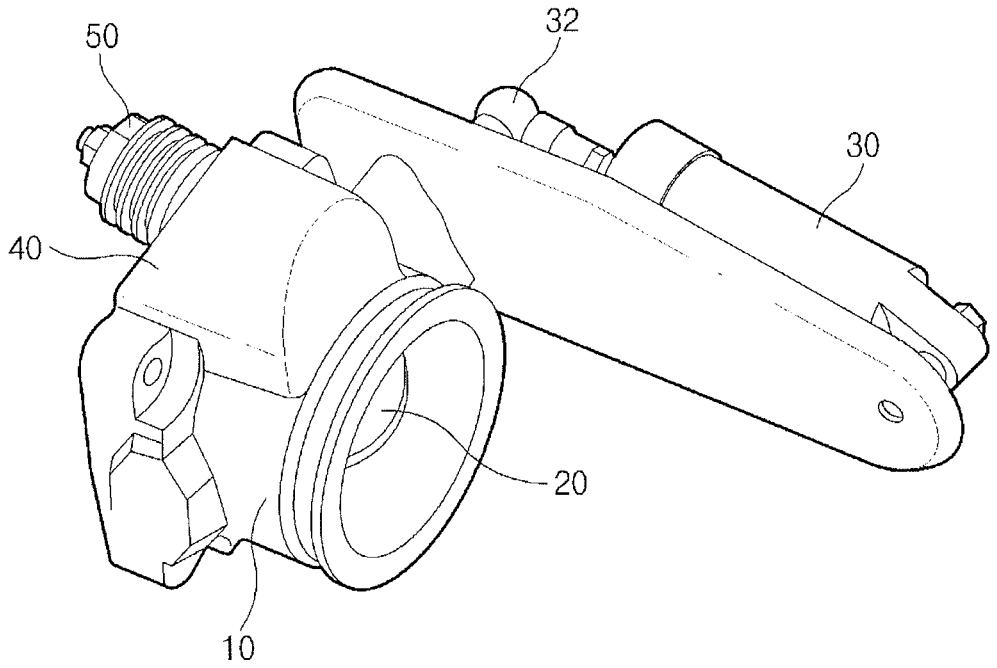
FIG. 2 is a perspective view illustrating an exemplary exhaust brake according to the present invention.
Figure 3:
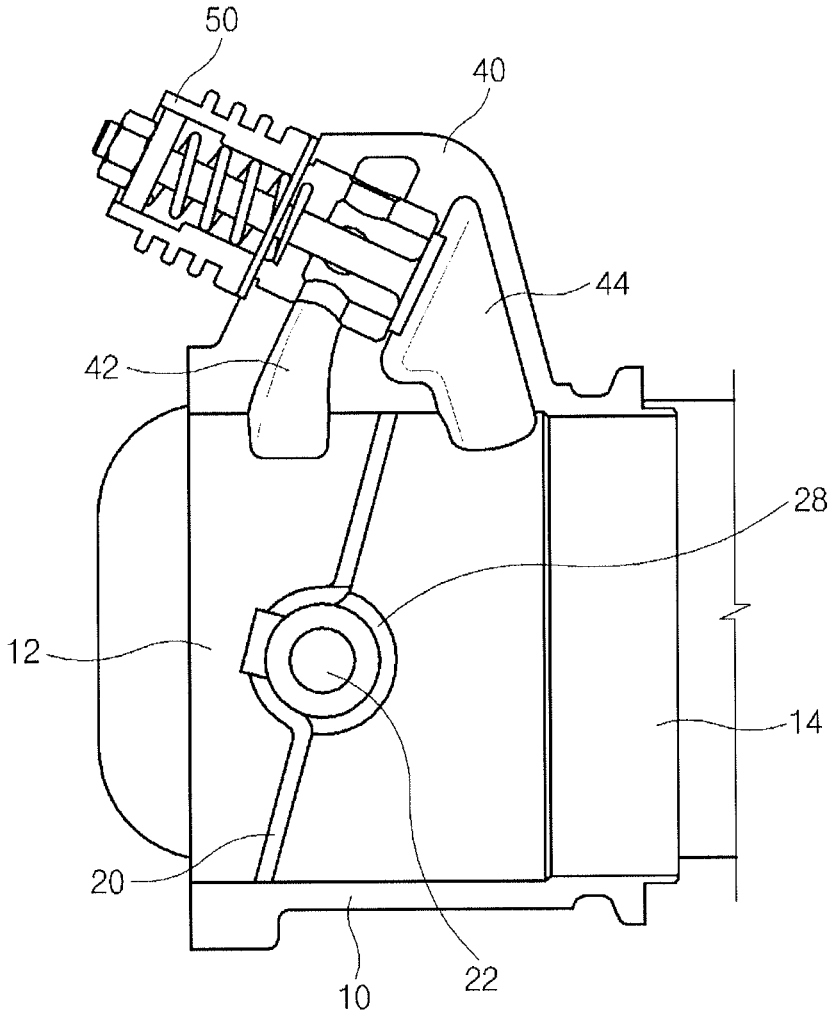
FIG. 3 is a cross-sectional view of the exhaust brake of FIG. 2.
Figure 4:
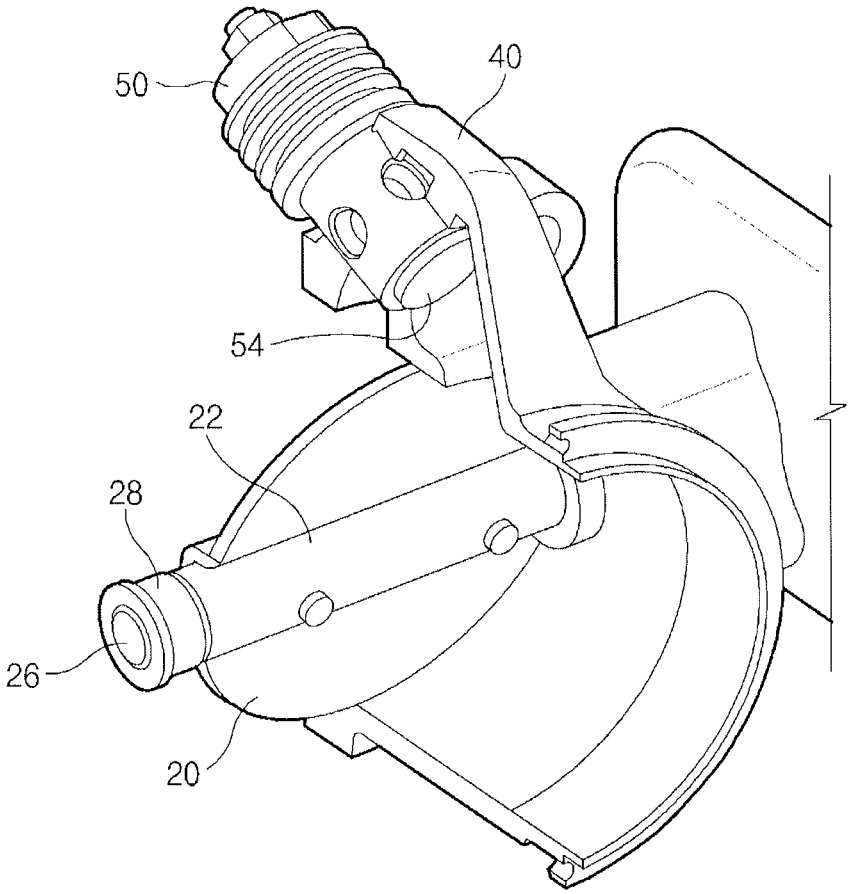
FIG. 4 is a partial cutaway perspective view of the exhaust brake of FIG. 2.
Figure 5:
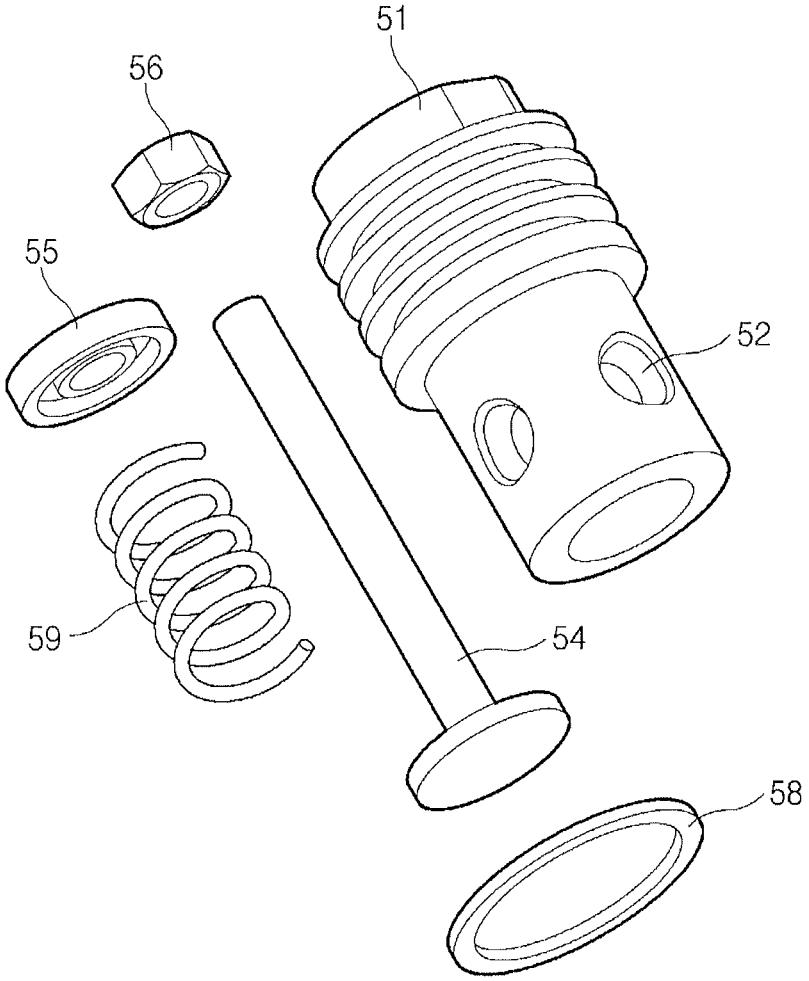
FIG. 5 is an exploded perspective view of an exemplary check valve which is applied to an exemplary exhaust brake according to the present invention.
Figure 6:
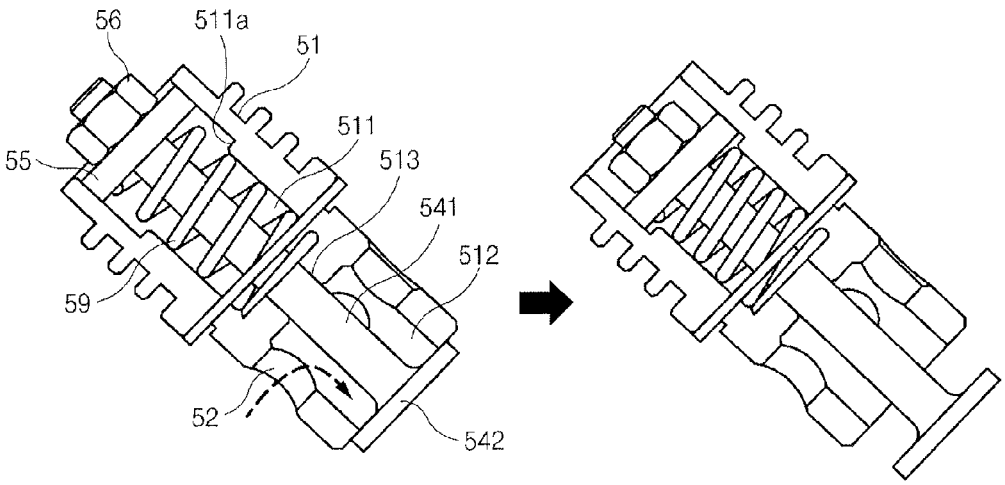
FIG. 6 is a cross-sectional view illustrating an exemplary operation of the check valve of FIG. 5.

FIG. 2 is a perspective view illustrating an exhaust brake according to various embodiments of the present invention, FIG. 3 is a cross-sectional view of the exhaust brake of FIG. 2, FIG. 4 is a partial cutaway perspective view of the exhaust brake of FIG. 2, FIG. 5 is an exploded perspective view of a check valve which is applied to the exhaust brake according to various embodiments of the present invention, and FIG. 6 is a cross-sectional view illustrating an operation of the check valve of FIG. 5.

According to various embodiments of the present invention, a bypass pipe 40 is formed in an exhaust pipe 10 with which a butterfly 20 between an exhaust upstream 12 and an exhaust downstream 14 is equipped and the bypass pipe 40 is equipped with a check valve 50.

The bypass pipe 40 has a bypass upstream 42 which starts between the exhaust upstream 12 and the butterfly 20 and a bypass downstream 44 which ends between the butterfly 20 and the exhaust downstream 14. Further, the check valve 50 is mounted between the bypass upstream 42 and the bypass downstream 44 to selectively discharge a back pressure.

Therefore, when the butterfly 20 stops the exhaust pipe 10 to form the back pressure, the back pressure of the exhaust upstream 12 is increased and thus the brake is caught. Further, when the back pressure exceeds a pressure set by the check valve 50, the pressure presses a piston head 542 of the check valve 50 to open the check valve, such that the back pressure is discharged along the bypass pipe 40.

The check valve 50 includes a cover 51 forming an appearance of the check valve and the inside thereof is inserted with a piston 54. A piston rod 541 of the piston is slidably inserted into the cover in a longitudinal direction. Further, the inside of the cover is equipped with a spring 59 which elastically supports the piston in a direction in which the check valve 50 is closed.

Describing the structure of the cover, the cover 51 is equipped with a hollow spring receiving part 511 and a gas passage part 512 and a piston rod support part 513 connecting between the spring receiving part 511 and the gas passage part 512, along a longitudinal direction of the piston.

A side of the gas passage part 512 is equipped with a gas hole 52 which communicates with the bypass upstream 42 side and an end (discharge port) thereof is opened toward the bypass downstream 44 side. The gas hole 52 is opened toward the bypass upstream 42 and a portion opened toward the bypass downstream 44 is opened and closed by the piston head 542.

Meanwhile, the piston rod support part 513 has a cross section corresponding to a cross section of the piston rod and thus serves to guide the piston rod 541. Therefore, the piston rod 541 is guided by the piston rod support part and slidably moves within the cover 51. Further, the cross section of the piston rod and the cross section of the support part have a shape corresponding to each other so as to be able to slidably move with respect to each other, such that it is possible to considerably prevent the back pressure of the gas passage part 512 from leaking toward the spring receiving part 511 through the piston rod support part 513.

The spring receiving part 511 is equipped with the spring and as illustrated, the spring 59 is inserted from an opened end of the spring receiving part 511 and thus the piston rod 541 is disposed to penetrate through the spring 59, in the state in which the spring receiving part 511 is inserted with the piston rod 541 from the end of the gas passage part 512 so that the piston rod 541 is disposed in the spring receiving part 511. Therefore, one end of the spring 59 is supported by a floor of the spring receiving part 511. Further, a piston guide 55 is again inserted into the piston rod 541 in the same direction as the direction in which the spring is inserted. The piston guide 55 is slidably inserted in a longitudinal direction of the piston rod 541 and supports the other end of the spring 59. Finally, the end of the piston rod 541 is screw-fastened with a nut 56.

In this case, the spring 59, which is a coil spring, is inserted outside the piston rod 541 and one side of the spring 59 which is inserted outside the piston rod is supported by the cover 51 and the other side thereof is supported by the piston rod, strictly, the piston guide 55 which is inserted into the piston rod and is restricted to movement in a direction slipped out from the piston rod due to the nut 56.

An inner diameter of the piston guide 55 is formed to correspond to a diameter of the piston rod and an outer diameter of the piston guide 55 is formed to correspond to an inner diameter of the spring receiving part 511, such that when the piston rod 541 slidably moves, the piston guide 55 contacts the receiving part and the movement of the piston rod is guided. Further, the piston guide prevents foreign matters from being introduced into the cover.

As illustrated in FIG. 6, when the inner diameter of the spring receiving part 511 is provided with a step part 511*a*, a maximum moving distance of the spring receiving part may be restricted.

Meanwhile, the nut 56 is screw-fastened with the end of the piston rod to prevent the piston guide from separating from the piston rod in the state in which the piston guide 55 is inserted into the piston rod 541. In this case, the movable range of the piston guide with respect to the piston rod may be controlled by controlling the position of the nut.

In addition, in the structure, when the nut 56 is tightened, the spring 59 has a more compressed initial state, such that a larger force is required to open the valve. Therefore, as the nut 56 is tightened, the spring becomes a more compressed initial state, such that the back pressure may control a pressure which starts to be discharged through the check valve 50, thereby controlling the back pressure.

Unlike the hole 24 applied to the butterfly 20 according to the related, since the check valve accurately sets the back pressure independent of the high speed section and the middle-low speed section and constantly keeps the back pressure, the back pressure brake performance may be maximally exerted and the back pressure higher than the set value is not generated, and thus does not affect the engine.

For example, when the back pressure rises higher than a required reference in the state (that is, during the operation of the exhaust brake) in which the butterfly 20 blocks the exhaust pipe 10, as illustrated in FIG. 6, the back pressure applies the pressure to the piston head 542 and the force of pressure is larger than an elastic force of the spring 59 to push the piston head 542 to a downstream so as to open the check valve 50, thereby discharging gas, whereas when the back pressure is reduced, the elastic force of the spring 59 is again larger than that of the back pressure applied to the piston head 542 to allow the piston head 542 to be pulled to an upstream so as to close the check valve 50.

According to various embodiments of the present invention, the piston head 542 of the piston 54 of the check valve 50 is disposed at the bypass downstream 44 side and the check valve is mounted so that the direction in which the piston head moves to the bypass downstream side becomes the direction in which the check valve is opened.

As such, the piston head 542 of the check valve may be disposed at the bypass downstream side and the exhaust downstream side. The bypass downstream and the exhaust downstream are in an atmospheric pressure and the pressure of gas discharged from the check valve is, e.g., about 5 bars. When the pressure of gas abruptly meets the low atmospheric pressure, the piston head 542 of the check valve is instantly applied with only a very small resistive force and the check valve may be smoothly operated. That is, the discharge port of the check valve needs to be disposed at a portion at which the pressure is not formed in the exhaust pipe.

To the contrary, when the piston head of the check valve is disposed at the bypass upstream side and the exhaust upstream side, the pressure is generated at all times and since the piston head is applied with a very large drag (e.g., 5 bar) which hinders the movement of the piston, the problem that the check valve is opened and then is not again closed may occur.

Meanwhile, according to various embodiments of the present invention, both ends of the rotating shaft 22 of the butterfly 20 are equipped with bushings 28. Both ends of the rotating shaft (referred to as a spindle) of the butterfly according to the related art are equipped with reduction parts 26. A gap is formed at the portion and thus gas may be leaked through the gap. When the portion is equipped with the bushing 28, the gap is blocked and thus air tightness is kept to prevent gas from leaking. Further, a portion at which the jamming problem often occurs is equipped with the bushing to induce the rotation of the bushing, thereby preventing the jamming phenomenon.

Therefore, in various embodiments, the bushing structure is added to seal between the butterfly 20 and the bushing 28 to more completely keep the air tightness, thereby more constantly keeping the back pressure. In addition, in some embodiments, when the check valve 50 is mounted in the bypass pipe 40, a gasket 58 is inserted, thereby preventing gas from leaking.

According to various embodiments of the present invention, the engine performance may be maximized at the predetermined back pressure and the engine may not be affected, even in the high speed section and the middle-low speed section without the loss in the back pressure by applying the check valve to the back pressure forming part to be able to satisfy the engine allowable back pressure.

Further, it is possible to improve the quality of the back pressure brake and more improve the back brake performance by minimizing the gap between the butterfly bending part and the exhaust pipe body and preventing the butterfly from being jammed.

In addition to the above-mentioned effects, various other effects of the present invention will be described while describing the detailed matters to practice the present invention.

For convenience in explanation and accurate definition in the appended claims, the terms "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An exhaust brake, comprising:

an exhaust pipe configured to include an exhaust upstream and an exhaust downstream;

a butterfly configured to be mounted between the exhaust upstream and the exhaust downstream in the exhaust pipe;

a bypass pipe configured to include a bypass upstream starting between the exhaust upstream and the butterfly and a bypass downstream ending between the butterfly and the exhaust downstream; and a check valve configured to be mounted between the bypass upstream and the bypass downstream, wherein a gas hole is disposed at a side of the check valve and an end of the gas hole is opened toward the bypass downstream, and a piston head of a piston of the check valve is disposed at the bypass downstream and a direction in which the piston head moves to the bypass downstream is a direction in which the check valve is opened.

2. The exhaust brake according to claim 1, wherein the check valve includes:

a cover configured to form an appearance of the check valve;

a piston configured to allow a piston rod to be slidably inserted into the cover in a longitudinal direction; and a spring configured to elastically support the piston in a direction in which the check valve is closed.

3. The exhaust brake according to claim 2, wherein the spring is a coil spring which is inserted outside the piston and is received in the cover, one side of the spring is supported by the cover, and an other side of the spring is supported by the piston.

4. The exhaust brake according to claim 3, wherein the piston rod is movably inserted with a piston guide in a longitudinal direction, an end of the piston rod is screw-fastened with a nut to prevent the piston guide from separating from the piston rod in the state in which the piston rod is inserted with the piston guide, and a movable range of the piston guide with respect to the piston rod is controlled by controlling a position of the nut.

5. The exhaust brake according to claim 4, wherein the other side of the spring is supported by the piston guide and thus the other side of the spring is supported by the piston.

6. The exhaust brake of any one of claims 2 to 5, wherein the cover is divided into a spring receiving part, a gas passage part, and a piston rod support part connecting between the spring receiving part and the gas passage part along the longitudinal direction of the piston which is inserted into the cover, the piston head is disposed at the gas passage part side, the piston rod support part has a cross section corresponding to a cross section of the piston rod, and the spring receiving part has the spring received therein.

7. The exhaust brake according to claim 1, wherein both ends of a rotating shaft of the butterfly are equipped with bushings.

8. The exhaust brake according to claim 7, wherein the both ends of the rotating shaft are provided with reduction parts of a diameter and the bushings are mounted at the reduction parts.

9. The exhaust brake according to claim 7, wherein air tightness is kept by sealing between the butterfly and the bushing.

10. The exhaust brake according to claim 3, wherein:

the cover is divided into a spring receiving part, a gas passage part, and a piston rod support part between the spring receiving part and the gas passage part along the longitudinal direction of the piston which is inserted into the cover;

the piston head is disposed at the gas passage part side;

the piston rod support part has a cross section corresponding to a cross section of the piston rod; and the spring receiving part has the spring received therein.

11. The exhaust brake according to claim 4, wherein:

the cover is divided into a spring receiving part, a gas passage part, and a piston rod support part between the spring receiving part and the gas passage part along the longitudinal direction of the piston which is inserted into the cover;

the piston head is disposed at the gas passage part side;

the piston rod support part has a cross section corresponding to a cross section of the piston rod; and the spring receiving part has the spring received therein.

12. The exhaust brake according to claim 5, wherein:

the cover is divided into a spring receiving part, a gas passage part, and a piston rod support part between the spring receiving part and the gas passage part along the longitudinal direction of the piston which is inserted into the cover;

the piston head is disposed at the gas passage part side;

the piston rod support part has a cross section corresponding to a cross section of the piston rod; and the spring receiving part has the spring received therein.

* * * * *